US012449245B2

(12) United States Patent
Stovall et al.

(10) Patent No.: US 12,449,245 B2
(45) Date of Patent: Oct. 21, 2025

(54) POWER CHARGE IGNITION

(71) Applicant: Hunting Titan, Inc., Pampa, TX (US)

(72) Inventors: Ty Stovall, Ennis, TX (US); Jeffrey Wayne Smith, St. Charles, MO (US); Johnny Covalt, Burleson, TX (US); Zachary James Taylor, Waxahachie, TX (US)

(73) Assignee: Hunting Titan, Inc., Pampa, TX (US)

( * ) Notice: Subject to any disclaimer, the term of this patent is extended or adjusted under 35 U.S.C. 154(b) by 31 days.

(21) Appl. No.: 18/440,748

(22) Filed: Feb. 13, 2024

(65) Prior Publication Data

US 2024/0183644 A1 Jun. 6, 2024

Related U.S. Application Data

(63) Continuation of application No. 17/632,485, filed as application No. PCT/US2020/046191 on Aug. 13, 2020, now Pat. No. 11,933,595.

(60) Provisional application No. 62/886,197, filed on Aug. 13, 2019.

(51) Int. Cl.

| | |
|---|---|
| ***F42D 1/04*** | (2006.01) |
| ***F42B 3/00*** | (2006.01) |
| *E21B 23/04* | (2006.01) |
| *F42D 1/045* | (2006.01) |

(52) U.S. Cl.

CPC ..... *F42D 1/04* (2013.01); *F42B 3/00* (2013.01); *E21B 23/0414* (2020.05); *F42D 1/045* (2013.01)

(58) Field of Classification Search

CPC .... F42D 1/04; F42D 1/045; F42B 3/00; F21B 23/0417

USPC ..... 102/282

See application file for complete search history.

(56) References Cited

U.S. PATENT DOCUMENTS

| | | | | |
|---|---|---|---|---|
| 3,235,182 | A * | 2/1966 | Ross | F23D 14/00 239/428 |
| 5,211,224 | A | 5/1993 | Bouldin | |
| 5,649,720 | A * | 7/1997 | Rink | B60R 21/264 222/3 |
| 5,712,444 | A * | 1/1998 | Brion | C06C 9/00 102/431 |
| 7,530,397 | B2 | 5/2009 | Bell | |
| 7,784,403 | B2 * | 8/2010 | Moulard | F42B 3/113 149/108.2 |
| 8,172,966 | B2 * | 5/2012 | Blau | F42B 12/42 149/40 |
| 2003/0226468 | A1 * | 12/2003 | Shilliday | C06D 5/06 102/531 |
| 2012/0067578 | A1 | 3/2012 | Wood et al. | |
| 2014/0332126 | A1 | 11/2014 | Nesveda | |

(Continued)

FOREIGN PATENT DOCUMENTS

| | | |
|---|---|---|
| BE | 653463 A | 1/1965 |
| CN | 2217212 | 1/1996 |

(Continued)

*Primary Examiner* — Samir Abdosh

(74) *Attorney, Agent, or Firm* — Troutman Pepper Locke LLP

(57) ABSTRACT

A method and apparatus for igniting a power charge in downhole wellbore using an ignition propellant mixed with a main propellant, the ignition propellant may be concentrated at the first end of a housing where it is the majority propellant and then gradually mix with the main propellant, transitioning to a majority of the main propellant.

26 Claims, 2 Drawing Sheets

(56) References Cited

U.S. PATENT DOCUMENTS

| | | | | |
|---|---|---|---|---|
| 2016/0053561 | A1 | 2/2016 | Carr et al. | |
| 2017/0350681 | A1* | 12/2017 | Campbell | C06B 25/04 |
| 2019/0162057 | A1* | 5/2019 | Montoya Ashton | E21B 43/1185 |
| 2022/0282960 | A1* | 9/2022 | Stovall | F42D 1/04 |

FOREIGN PATENT DOCUMENTS

| | | | |
|---|---|---|---|
| CN | 204457597 | U | 7/2015 |
| CN | 104863551 | B | 8/2015 |
| JP | 6131711 | | 5/2017 |

* cited by examiner

POWER CHARGE IGNITION

RELATED APPLICATIONS

This application is a continuation of U.S. application Ser. No. 17/632,485, Filed Feb. 2, 2022, which is a national stage application of PCT/US20/46191, filed Aug. 13, 2020, which claims the benefit of Provisional Application No. 62/886,197, filed on Aug. 13, 2019 titled "Power Charge Ignition."

BACKGROUND OF THE INVENTION

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically, a wellbore will be drilled from a surface location, placing a hole into a formation of interest. Completion equipment will be put into place, including casing, tubing, and other downhole equipment as needed. Perforating the casing and the formation with a perforating gun is a well known method in the art for accessing hydrocarbon deposits within a formation from a wellbore.

Setting tools can be used for many applications, including setting bridge plugs. Bridge plugs are often introduced or carried into a subterranean oil or gas well on a conduit, such as wire line, electric line, continuous coiled tubing, threaded work string, or the like, for engagement at a pre-selected position within the well along another conduit having an inner smooth inner wall, such as casing. The bridge plug is typically expanded and set into position within the casing. The bridge plug effectively seals off one section of casing from another. Several different completions operations may commence after the bridge plug is set, including perforating and fracturing. Sometimes a series of plugs are set in an operation called "plug and perf" where several sections of casing are perforated sequentially.

Setting a bridge plug typically requires setting a "slip" mechanism that engages and locks the bridge plug with the casing and energizing the packing element in the case of a bridge plug. This requires large forces, often in excess of 20,000 lbs. The activation or manipulation of some setting tools involves the activation of an energetic material such as a pyrotechnic charge, referred to as a power charge, to provide the energy needed to set a bridge plug. The energetic material may use a relatively slow burning chemical reaction to generate high pressure gases. One such setting tool is the Model E-4 Wireline Pressure Setting Tool of Baker International Corporation, sometimes referred to as the Baker Setting Tool.

A firing head may also be used in conjunction with a setting tool. A firing head is used to trigger the setting. The firing head may be activated by an electrical signal. Electricity may be provided by a wireline that ties into the cable head at the top of a tool string. The electrical signal may have to travel through several components, subs, and tools before it gets to the firing head. A reliable electrical connector is needed to ensure the electrical signal can easily pass from one component to the next as it moves down the tool string. The electrical signal is typically grounded against the tool string casing. As a result, the electrical connections must be insulated from tool components that are in electrical contact with the tool string casing.

SUMMARY OF EXAMPLE EMBODIMENTS

An example embodiment may include a power charge having a tubular housing having a first end, a second end, and a mid-section, a main propellant within the housing proximate the mid-section comprising a main propellant, and a first ignition portion within the housing proximate the first end comprising a first mixture of the main propellant and an ignition propellant.

A variation of the example embodiment may include the ignition propellant having a propagation index of 1.5 or greater and the main propellant has a propagation index of 1.5 or less. It may include the ignition propellant having a propagation index of 2.0 or more. It may include the ignition propellant having a propagation index of 2.75 or more. It may include the first ignition propellant containing boron potassium nitrate. It may include the first mixture of main propellant and ignition propellant having a gradient with predominately ignition propellant towards the first end and transitioning to primarily main propellant away from the first end. It may include the gradient ranging from 90% or more ignition propellant near the first end to 10% or less ignition propellant away from the first end. It may include the first ignition portion extending between 0.5 inch and 1.5 inches from the first end. It may include the ignition portion extending from the end of the housing approximately 12.5% to 25% of the length of the housing. It may include the first ignition portion being approximately 1.50% of the power charge by weight.

An example embodiment may include a power charge having a tubular housing having a first end, a second end, and a mid-section, a main propellant within the housing proximate the mid-section comprising a main propellant, a first ignition portion within the housing proximate the first end comprising a first mixture of the main propellant and an ignition propellant, and a second ignition portion within the housing proximate the second end comprising a second mixture of the main propellant and the ignition propellant.

A variation of the example embodiment may include the ignition propellant having a propagation index of 1.5 or greater and the main propellant has a propagation index of 1.5 or less. It may include the ignition propellant having a propagation index of 2.0 or more. It may include the ignition propellant having a propagation index of 2.75 or more. It may include the ignition propellant containing boron potassium nitrate. It may include the first mixture of main propellant and ignition propellant having a gradient with predominately ignition propellant towards the first end and transitioning to primarily main propellant away from the first end and the second mixture of main propellant and ignition propellant having a gradient with predominately ignition propellant towards the second end and transitioning to primarily main propellant away from the second end. It may include the first gradient ranging from 90% or more ignition propellant near the first end to 10% or less ignition propellant away from the first end and the second gradient ranging from 90% or more ignition propellant near the second end to 10% or less ignition propellant away from the second end. It may include the first ignition portion extending between 0.5 inch and 1.5 inches from the first end and the second ignition portion extending between 0.5 inch and 1.5 inches from the second end. It may include the ignition portion extending from the end of the housing approximately 12.5% to 25% of the length of the housing. It may include the first and second ignition portion combined being approximately 3.0% of the power charge by weight.

BRIEF DESCRIPTION OF THE DRAWINGS

For a thorough understanding of the present invention, reference is made to the following detailed description of the preferred embodiments, taken in conjunction with the accompanying drawings in which reference numbers designate like or similar elements throughout the several figures of the drawing. Briefly.

DETAILED DESCRIPTION OF EXAMPLES OF THE INVENTION

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

Figure 2:
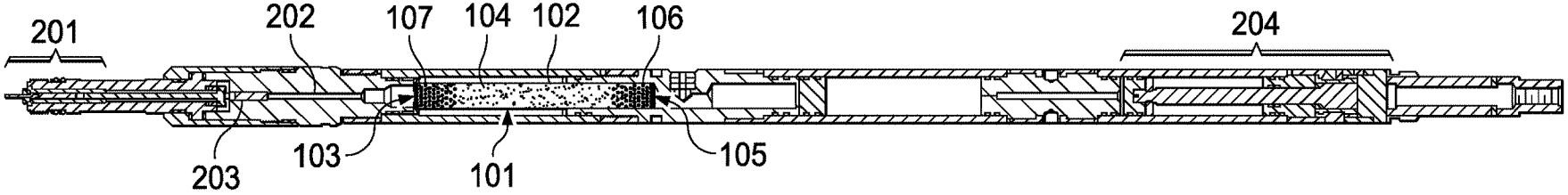
FIG. 2 shows a side view cutaway of a setting tool with a power charge.
Figure 3:
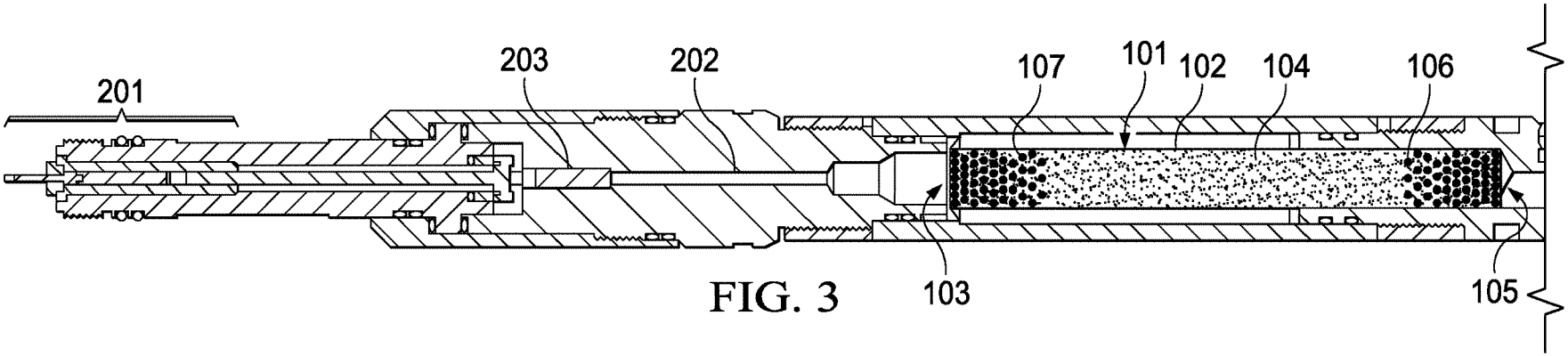
FIG. 3 shows a side view cutaway of a setting tool with a power charge.

FIG. 2 and FIG. 3 show an example setting tool with an electrical connection 201 an igniter 203, a power charge 101, and a piston 204. In operation, signals through electrical connection 201 cause igniter 203 to emit heat and, typically, flames. The output of igniter 203 ignites a propellant in power charge 101, via pathway 202, which produces pressure that ultimately drives piston 204, to actuate a tool, such as a wellbore plug. Sometimes, a secondary material such as pyrodex is placed in an ignition path between the igniter and power charge to improve reliability of the ignition transfer.

A propellant can be classified by its propagation index (PI), defined by the ratio of the energy output ($\Delta H_{Reaction}$) in Calories per gram over auto ignition temperature ($T_{Ignition}$) in degrees Celsius.

$$PI = \frac{\Delta H_{Reaction}}{T_{Ignition}}$$

Power charges typically include a main propellant, typically with a metallic fuel and an oxidizer with a binder like epoxy. In some examples, these components are mixed in ratios of 33-85% epoxy, 0-20% fuel, and 20-67% oxidizer. In one example, the fuel is aluminum and the oxidizer is potassium nitrate in an epoxy binder. Other possible fuels for the main propellant include: Iron, Magnesium, Magnalium (Magnesium/Aluminum 50/50 alloy), Titanium, Tungsten, Zinc, Zirconium, Boron, Sulfur, Charcoal, and Graphite. Other possible oxidizers for the main propellant include: Ammonium Nitrate, Ammonium Perchlorate, Barium Chlorate, Barium Chromate, Barium Nitrate, Barium Peroxide, Iron (III) Oxide (red), Iron (II, III) Oxide (black), Lead Chromate, Lead Dioxide, Lead Oxide, Lead Tetroxide, Potassium Chlorate, Potassium Perchlorate, Sodium Nitrate, and Strontium Nitrate. A main propellant typically has a propagation index of less than 1.5 Cal/(g deg C.). Example main propellants may have a propagation index of less than 0.5 Cal/(g deg C.). Example main propellants may have an auto ignition temperature of over 1000 degrees Celsius. Example main propellants may have an energy output of 500 Calories per gram or less.

Figure 1A:
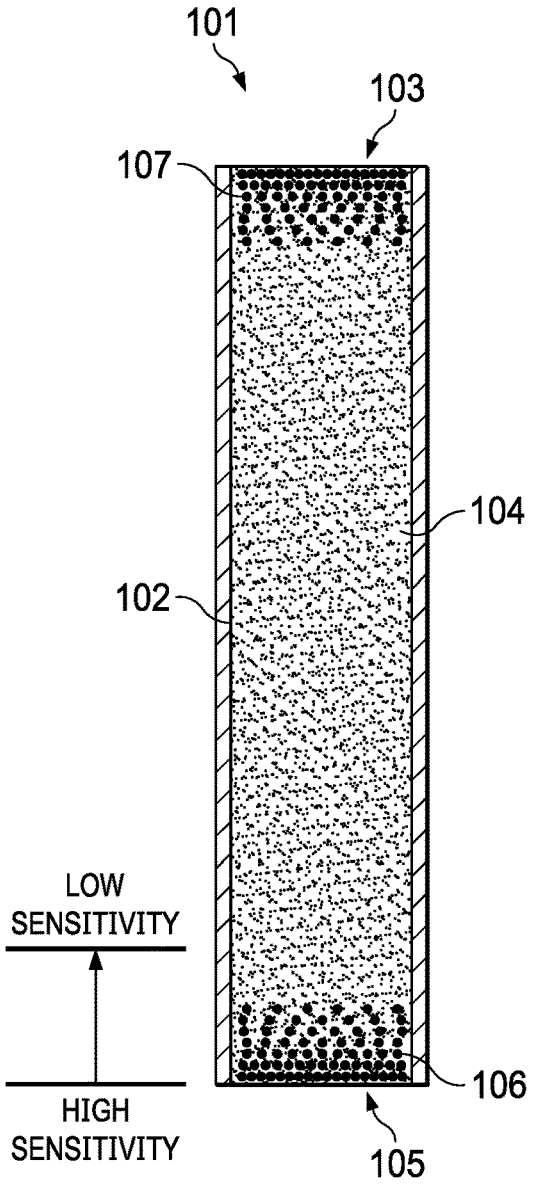
FIG. 1A shows a side view cutaway of a power charge.
Figure 1B:
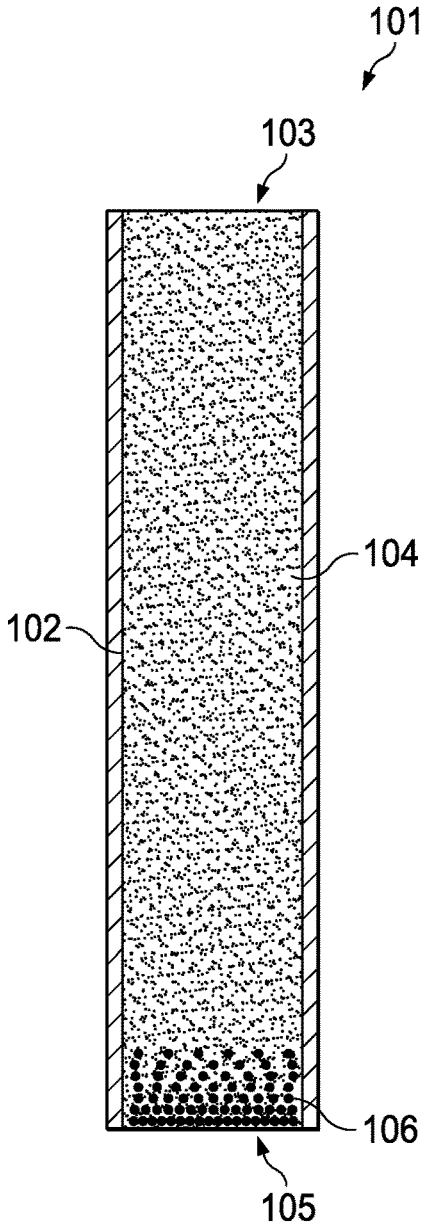
FIG. 1B shows a side view cutaway of a power charge.

In an example embodiment of FIG. 1B, a power charge 101 is shown in a tubular housing 102. The tubular housing has a first end 105, a second end, 103 and a mid-section between the first and second ends. There is a main propellant 104 in the mid-section of housing 102.

In the first end 105 of the housing, there is a first ignition portion 106 of pyrotechnic material made of a mixture of a main propellant 104 and an ignition propellant. The ignition propellant is a material that is generally more sensitive to ignition than the main propellant and generally has a greater energy output than the main propellant. In some examples, the ignition propellant has an auto ignition temperature no higher than 600 degrees Celsius. In some examples, the ignition propellant has an energy output of at least 900 Calories per gram. In some examples, the ignition propellant has an energy output of over 1500 Calories per gram. An ignition propellant typically has a propagation index of at least 1.5 Cal/(g deg C.). An ignition propellant typically has an auto ignition temperature of 600 degrees Celsius or less. Examples ignition propellant have a propagation index of 2.75 or more Cal/(g deg C.).

Examples of ignition propellant are boron potassium nitrate ($BKNO_3$), zirconium potassium perchlorate (ZPP), titanium hydride potassium perchlorate (THPP), Pyrodex, Triple 7, Black Powder, aluminum potassium perchlorate. $BKNO_3$ has a heat of reaction of approximately 1,600 Calories/gram and an auto ignition temperature of 565 degrees Celsius, giving a propagation index of 2.83 Cal/(g deg C.). Pyrodex and Triple 7 have a heat of reaction of approximately 1,100 Calories/gram and an auto ignition temperature of 399 degrees Celsius, giving a propagation index of 2.76 Cal/(g deg C.). Black Powder has a heat of reaction of approximately 660 Calories/gram and an auto ignition temperature of 330 degrees Celsius, giving a propagation index of 2.00 Cal/(g deg C.). In some examples, there is a second ignition portion 107 near the second end 103 of the housing as shown in FIG. 1A. In some examples, the first ignition portion 106 and the second ignition portion 107 combined may be approximately 3.0% of the power charge by weight.

Preferably, the mixture in the first ignition portion 106 or second ignition portion 107 is mixed in a gradient with predominately ignition propellant towards the first end and transitioning to primarily main propellant away from the first end. In some examples, the mixture will range from 90% or more ignition propellant near the end of the housing to 10% or less ignition propellant away from end of the housing. In some examples, the ignition portions 106 or 107 extend approximately 0.5 inch from the end of the housing. In some examples, the ignition portions 106 or 107 extend approximately 1 inch from the end of the housing. In some examples, the ignition portions 106 or 107 extend approximately 1.5 inch from the end of the housing. In some examples, the ignition portions 106 or 107 extend approximately 0.5 to 1 inch from the end of the housing. In some examples, the ignition portions 106 or 107 extend approximately 1 to 1.5 inches from the end of the housing. In some examples, the ignition portions 106 or 107 extend from the end of the housing approximately 12.5% of the length of the housing. In some examples, the ignition portions 106 or 107 extend from the end of the housing approximately 25% of the length of the housing. In some examples, the ignition propellant is approximately 0.75% of the power charge by weight. In some examples, the ignition propellant is approximately 1.5% of the power charge by weight. In some examples, the ignition propellant is approximately 3.0% of the power charge by weight. In some examples, the first ignition portion is approximately 1.50% of the power charge by weight.

The main propellant 104 is in the interior of the housing adjacent to the ignition portion. In some examples, the housing 102 is a cardboard tube.

Further examples include a method of manufacturing a power charge. In one method, the housing is placed vertically with the first end down with a cap over it. The ignition propellant 106 is then placed inside the housing so that it settles in the first end. The main propellant is then poured into the housing where it partially mixes with the ignition material to form the first ignition portion. The main propellant then sets, such as an epoxy binder portion of the main propellant curing. Optionally, ignition material can also be added to the housing after the main propellant has been put into the housing to create the second ignition portion.

Each of the examples for the ignition portion can apply to an ignition portion at the first end or the second end.

Although the invention has been described in terms of embodiments which are set forth in detail, it should be understood that this is by illustration only and that the invention is not necessarily limited thereto. For example, terms such as upper and lower or top and bottom can be substituted with uphole and downhole, respectfully. Top and bottom could be left and right. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. The first housing and second housing may be top housing and bottom housing, respectfully. Terms like wellbore, borehole, well, bore, oil well, and other alternatives may be used synonymously. The alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A setting tool comprising:

an igniter;

a power charge having a first end, a second end, a mid-section, a main propellant within the housing proximate the mid-section comprising a main propellant, and a first ignition portion within the housing proximate the first end comprising a first mixture of the main propellant and an ignition propellant; and a piston;

wherein the igniter ignites the first ignition portion which produces pressure that drives the piston.

2. The setting tool of claim 1 wherein the power charge further comprises a tubular housing.

3. The setting tool of claim 1 further comprising an electrical connection wherein signals passing through the electrical connection cause the igniter to emit heat.

4. The setting tool of claim 1 wherein the ignition propellant has an auto ignition temperature of 600 degrees Celsius or less.

5. The setting tool of claim 1 wherein the ignition propellant has a propagation index of 1.5 or greater and the main propellant has a propagation index of 1.5 or less.

6. The setting tool of claim 1 wherein the ignition propellant has a propagation index of 2.0 or more.

7. The setting tool of claim 1 wherein the ignition propellant has a propagation index of 2.75 or more.

8. The setting tool of claim 1 wherein the ignition propellant is boron potassium nitrate.

9. The setting tool of claim 1 wherein the first mixture of main propellant and ignition propellant comprises a gradient with predominately ignition propellant towards the first end and transitioning to primarily main propellant away from the first end.

10. The setting tool of claim 7 wherein the gradient ranges from 90% or more ignition propellant near the first end to 10% or less ignition propellant away from the first end.

11. The setting tool of claim 1 wherein the first ignition portion extends between 0.5 inch and 1.5 inches from the first end.

12. The setting tool of claim 1 wherein the ignition portion extends from the end of the housing 12.5% of the length of the housing.

13. The setting tool of claim 1 wherein the ignition portion extends from the end of the housing 25% of the length of the housing.

14. A setting tool comprising:

an igniter;

a power charge having a tubular housing having a first end, a second end, a mid-section, a main propellant within the housing proximate the mid-section comprising a main propellant, a first ignition portion within the housing proximate the first end comprising a first mixture of the main propellant and an ignition propellant, and a second ignition portion within the housing proximate the second end comprising a second mixture of the main propellant and the ignition propellant; and a piston wherein the igniter ignites the first or second ignition portion propellant which produces pressure that drives the piston.

15. The setting tool of claim 14 further comprising an electrical connection wherein signals passing through the electrical connection cause the igniter to emit heat.

16. A power charge for activating a downhole tool within a wellbore, comprising:

a tubular housing adaptable for insertion into the wellbore;

a main propellant contained within the tubular housing, configured to generate a controlled explosive force upon ignition;

an ignition portion situated within the tubular housing, comprising a first propellant with an auto-ignition temperature designed to initiate combustion of the main propellant; and wherein the ignition portion includes a gradient of propellant mixtures varying in composition to control the ignition sequence, thereby ensuring the effective and efficient activation of the downhole tool in subterranean conditions.

17. The power charge of claim 16, wherein the tubular housing is made from a material selected from the group consisting of steel, aluminum, and composite materials to withstand high-pressure conditions in the wellbore.

18. The power charge of claim 16, further comprising a sealing mechanism integrated with the tubular housing for preventing wellbore fluids from entering the housing and affecting the propellants.

19. The power charge of claim 16, wherein the main propellant comprises a mixture of high-energy materials capable of generating a gas volume sufficient to actuate the downhole tool.

20. The power charge of claim 16, wherein the ignition portion further includes a second propellant with a higher auto-ignition temperature than the first propellant, arranged to sequentially ignite and control the combustion process.

21. The power charge of claim 16, wherein the gradient of propellant mixtures includes variations in the proportions of oxidizer to fuel, enabling a tailored ignition profile to match specific downhole conditions.

22. The power charge of claim 16, further comprising an electronic ignition system configured to initiate the ignition sequence of the ignition portion remotely.

23. The power charge of claim 16, wherein the tubular housing includes external threads at one or both ends for attachment to other downhole components or tools.

24. The power charge of claim 16, wherein the proportion of the ignition portion to the total weight of the power charge ranges from 1% to 10%, optimizing the balance between ignition sensitivity and explosive output.

25. The power charge of claim 16, wherein the main propellant is configured in a geometric arrangement within the tubular housing to maximize the efficiency of gas generation and directional force application upon ignition.

26. The power charge of claim 16, wherein the power charge includes a safety mechanism to prevent unintended ignition due to environmental conditions outside predetermined operational parameters.

* * * * *